United States Patent [19]

O'Connor

[11] Patent Number: 4,698,029

[45] Date of Patent: Oct. 6, 1987

[54] EURO CONNECTOR WITH SPACE ARRANGEMENT TO PERMIT MOUNTING OF MALE AND FEMALE CONNECTORS

[75] Inventor: Robert G. O'Connor, Greene, N.Y.

[73] Assignee: General Electric Co., Schenectady, N.Y.

[21] Appl. No.: 893,052

[22] Filed: Aug. 1, 1986

[51] Int. Cl.[4] ..... H01R 13/645

[52] U.S. Cl. ..... 439/532

[58] Field of Search ..... 339/119 R, 121, 176 M, 339/186 M

[56] References Cited

U.S. PATENT DOCUMENTS 4,046,443 9/1977 Champagne ..... 339/186 M X 4,363,530 12/1982 Verhoeven ..... 339/176 M X 4,579,412 4/1986 Czeschka ..... 339/186 M X

*Primary Examiner*—Eugene F. Desmond

*Attorney, Agent, or Firm*—I. D. Blumenfeld

[57] ABSTRACT

Electrical connectors of the Euro connector type for mounting the male and female connectors of different heights with standard mounting guide rails. Mounting of the different size male and female connectors with standard size guide rails is achieved by means of a suitable spacer which mates with the guide rail when a shorter male connector is used.

This invention relates to a Euro connector assembly, and, more particularly, an assembly in which male and female connectors of different heights may be mounted utilizing a standard height guide.

2 Claims, 1 Drawing Figure

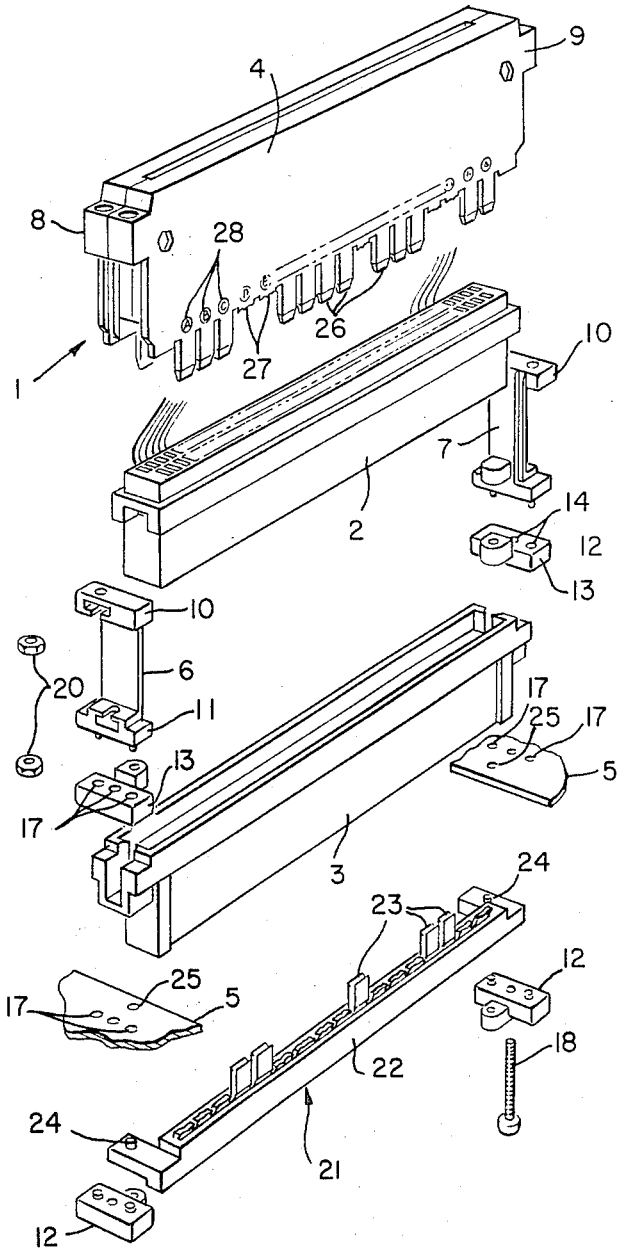
9
4
8
28
26
27
1
10
7
2
14
12
13
10
6
20
11
17
25
17
5
13
17
3
24
23
12
25
17
5
18
22
24
21
12

EURO CONNECTOR WITH SPACE ARRANGEMENT TO PERMIT MOUNTING OF MALE AND FEMALE CONNECTORS

BACKGROUND OF THE INVENTION

It is well known that in many standard connector assemblies, particularly of the type known as the Euro connector assemblies, the male and female connectors are of different heights. Furthermore, male and female connectors of these types are mounted to chassis or boards, etc., while positioned inside of a housing with the housing connected to the chassis by means of a standard size c-shaped guide rails. Because the guide rail is of a standard size, problems exist in mounting male and female connectors without altering the parts themselves or the chassis assembly.

SUMMARY OF THE INVENTION

Applicant has discovered that both male and female connectors may be mounted to a chassis or support element utilizing standard size mounting guides by means of spacer elements which mate with the guide rails to maintain the particular elements of the same height with respect to the chassis. The spacer allows the connector to be mounted on the chassis using standard mounting holes. Furthermore, the spacer construction involves alignment pins and openings on opposite sides thereof which allow it to mate with alignment pins on the guide rails on one side of the chassis and pass through the mounting holes of the chassis on the opposite side.

It is therefore a principal objective of the invention to provide Euro connector assembly including a spacer which permits use of male and female connectors with a standard heighth mounting guide rail.

Other objectives and advantages of the invention will be apparent as the description thereof proceeds.

The objectives and advantages of the invention are realized in a Euro connector assembly in which a spacer assembly is provided which mates with the guide rails which connect the connectors and housing to the chassis in the event a shorter male connector is to be assembled. The spacer holds the male connector to the chassis and allows use of the standard mounting hole pattern for a standard Euro guide rail. The spacer may also be used on the opposite side of the chassis to mount other elements.

Other features believed characteristic of the invention are set forth with particularity in the appended claims. The invention itself, however, with other objectives and advantages thereof would be best understood by reference to the following description taken in conjunction with the accompanying drawing in which:

BRIEF DESCRIPTION OF THE DRAWING

The sole FIGURE is an exploded perspective of the Euro connector, chassis, standard guide rail and plastic spacer.

DETAILED DESCRIPTION OF THE PREFERRED EMBODIMENT

The drawing illustrates a Euro connector assembly 1 in which a male connector 2 or a female connector 3 is mounted inside of a housing or hood 4. It may be seen from observation in the FIGURE, the male and female connectors are of different heights with the female connector being higher than the male connector. The housing is connected to a chassis 5 by means of guide rails 6 and 7 which are secured to the shoulders 8 and 9 of the housing or hood. The guide rails in Euro connectors are of a standard height and include flanges 10 and 11 which are respectively connected to shoulders 8 and 9 on the housing and to chassis 5. The guide rails are of the height to connect the housing to the chassis when the larger female connector is secured within the housing. When, however, the shorter male connector is positioned within the housing, the lower flange of the guide rail is connected to the chassis by means of a plastic spacer 12 which permits mounting of the connector assembly to the chassis without changing the chassis. Plastic spacer consists of a main body 13 which contains three openings 14, the central one of which extends entirely through the main body to receive mounting screws for the guide. The outer openings 14 extend partially through the body and are aligned to receive alignment pins, not shown, extending from the underside of the lower flange 11 of the guide rails. Similarly, a pair of alignment pins, not shown, extend from the underside of spacer body 13 and fit into the outer two mounting holes 17 in chassis 5. Center hole 17 constitutes a clearance hole for a screw 18 which passes through the center hole of the spacer body and into the lower flanges of guide rails 6 and 7. The lower flanges of guide rails 6 and 7 contain openings which capture nuts 20 so that rotation of screws 18 pulls the guide rails downward into contact with the spacer and the chassis. Similarly, the upper flange contains an opening which captures a nut 20. Screws pass through the upper shoulders 8 and 9 of the housing so that rotation of the upper screws pulls the shoulder and housing of the connector downward against the upper flange of the guide rails.

The design of plastic spacers 12 with holes in the upper surface and alignment pins on the lower surfaces allows the spacer to be used above the chassis to space the guide rail from the upper side of the chassis by receiving the mounting pins on the lower side of the guide rail. Spacers 12 mounted underneath the chassis attach a coding strip 21 to the underside of the chassis. Coding strip 21 consists of a base 22 having a plurality of projections or index keys 23 which may be selectively removed to mate with the similar code keys or projections presently to be described on housing 4 to identify the connectors as well as interlocking or latching the housing with the coding strip. Coding strip 21 also contains alignment pins 24 which pass through offset clearance hole 25 in the chassis to secure the coding strip to the underside of the chassis.

Housing 4, and the keying code identification members forming part of the housing are shown as projections integral with and projecting from the lower part of the housing; i.e. they consist of a plurality (shown as 16 in the figure) of removable teeth projecting from the lower part of the housing with these projections forming the indicia elements for identifying the conductors. Although the projecting indicia elements are shown as integral with the housing, it will be understood that they need not necessarily be so since the housing can be made with a cutout in the lower portion thereof and the indicia elements being attached thereto in the form of a plate having the teeth projecting from the bottom thereof and secured to the housing.

Selectively removable indicia elements or teeth 26 project from the housing and also include an undercut or reduced neck portion 27 which allow the teeth to be removed easily prior to assembly of the connector to the chassis 5. Located above each of the teeth and shown as molded directly into the housing they are a plurality of indices 28 identifying wire groupings. These may be letter groupings or any indicia which would then indicate that wherever a tooth has been removed that particular wire grouping is contained in the connector. Thus by removing various combinations of these teeth the connector and wires may be readily identified and are immediately visible by looking at the connector when mounted to the chassis. By selectively removing various combinations of the projections, keying codes combinations in excess of 250 are readily achievable by means of the 16 teeth shown in the drawing.

For example, starting from the left hand side the 2nd, 5th, 7th, and 9th teeth were removed indicate a particular combination, then all the teeth but the 2nd, 5th, 7th, and 9th on the coding strip mounted beneath the chassis would be modified to provide a "mirror image" of the coding on the housing. That is, all teeth but the 2nd, 5th, 7th, and 9th would be removed. Thus when the assembly takes place these teeth in the coding bar would mate with the openings in the lower part of the housing resulting from the removal of teeth 2, 5, 7, and 9. Thus, it can be seen, therefore, that this prevents any mismating or positioning of the wrong connector assembly because the teeth in the upper housing and the lower coding bar would interfere preventing assembly to the chassis. Thus the lower coding bar performs an interlock or latching function to prevent incorrect assembling of the connector assembly thus preventing damage caused by incorrectly mated connectors.

It would thus be apparant from the description that the connector assembly may be secured to a chassis utilizing a standard height guide rail whether the connector in the housing assembly are of different sizes; i.e., male or female connectors. This may be readily realized by means of the novel plastic spacer of the instant invention as described above.

This innovation allows the Euro connector system to be used as a conventional chassis connector cabling system. Prior to this invention Euro connectors were limited to circuit card applications.

While a particular embodiment of this invention has been shown, it will be understood that the invention is by no means limited thereto since many modifications in the structural arrangement and the instrumentalities employed may be made. It is contemplated by the appended claims to cover any such modifications as fall within the true spirit and scope of this invention.

What is claimed as new and desired to be secured by U.S. Letters Patent is:

1. A connector assembly including:

(a) a housing for retaining different sized male and female connectors, (b) at least one connector secured in said housing for retaining connector cables, (c) supporting elements attached to said housing and adapted to be mounted on a chassis, said supporting elements including alignment pins on the side facing a chassis and aligned with mounting holes on said chassis, when a connector of one height is mounted in said housing, (d) a spacer element for mating with said support element and a chassis when a connector of a different size is mounted in said housing, said spacer element having openings on one side thereof aligned with and adapted to receive the alignment pins on said support element and having alignment pins on the other side thereof aligned with mounting holes in the chassis.

2. The connector assembly according to claim 1 wherein said support element is a guide rail having an upper flange for attachment to said housing and a lower flange for attachment to a chassis, said lower flange having said alignment pins extending therefrom.

* * * * *